US008246147B2

(12) United States Patent
Tamura et al.

(10) Patent No.: US 8,246,147 B2
(45) Date of Patent: Aug. 21, 2012

(54) INKJET PRINTHEAD SUBSTRATE, METHOD FOR MANUFACTURING INKJET PRINTHEAD SUBSTRATE, INKJET PRINT HEAD, AND INKJET RECORDING APPARATUS

(75) Inventors: Hideo Tamura, Kawasaki (JP); Yoshiyuki Imanaka, Kawasaki (JP); Koichi Omata, Kawasaki (JP); Takaaki Yamaguchi, Yokohama (JP); Kousuke Kubo, Yokohama (JP); Yuuji Tamaru, Yokohama (JP); Ryoji Oohashi, Yokohama (JP); Toshio Negishi, Kawasaki (JP); Kazuaki Shibata, Oita (JP)

(73) Assignee: Canon Kabushiki Kaisha, Tokyo (JP)

( * ) Notice: Subject to any disclaimer, the term of this patent is extended or adjusted under 35 U.S.C. 154(b) by 448 days.

(21) Appl. No.: 12/484,649

(22) Filed: Jun. 15, 2009

(65) Prior Publication Data

US 2009/0309930 A1 Dec. 17, 2009

(30) Foreign Application Priority Data

Jun. 16, 2008 (JP) ..... 2008-156635
Feb. 13, 2009 (JP) ..... 2009-030896

(51) Int. Cl.
*B41J 2/14* (2006.01)
*B41J 2/16* (2006.01)

(52) U.S. Cl. ..... 347/50
(58) Field of Classification Search ..... None
See application file for complete search history.

(56) References Cited

U.S. PATENT DOCUMENTS 6,431,678 B2 * 8/2002 Beck et al. ..... 347/19
2007/0211115 A1 * 9/2007 Ibe et al. ..... 347/58

FOREIGN PATENT DOCUMENTS

JP 7-60954 3/1995

* cited by examiner

*Primary Examiner* — Matthew Luu
*Assistant Examiner* — Renee I Wilson
(74) *Attorney, Agent, or Firm* — Canon USA Inc IP Division

(57) ABSTRACT

An inkjet printhead substrate includes: a heat generating element configured to generate energy for ejecting ink; an electric wire electrically connecting the heat generating element and an electrode lead provided on a flexible film wiring substrate; a protecting film configured to protect the electric wire; an electrode pad to which the electrode lead is connected, the electrode pad being formed by providing an opening in the protecting film at a position above the electric wire; a region to which a sealing resin configured to protect an electrically connected portion of the electrode pad and the electrode lead is to be applied; and an ink-detecting electrode composed of a metal wire and formed at the region to which the sealing resin is to be applied. The metal wire has a smaller width than an opening provided in the protecting film from which the metal wire is exposed.

13 Claims, 9 Drawing Sheets

INKJET PRINTHEAD SUBSTRATE, METHOD FOR MANUFACTURING INKJET PRINTHEAD SUBSTRATE, INKJET PRINT HEAD, AND INKJET RECORDING APPARATUS

BACKGROUND OF THE INVENTION

1. Field of the Invention

The present invention relates to an inkjet printhead substrate used in an inkjet print head that performs recording by discharging ink droplets from discharge ports and to a method for manufacturing the inkjet printhead substrate. The present invention also relates to an inkjet print head including such an inkjet printhead substrate and to an inkjet recording apparatus including such an inkjet print head.

2. Description of the Related Art

An example of the inkjet print head has an inkjet recording chip as shown in FIGS. 8A to 8C.

FIGS. 8A to 8C are a plan view, a bottom view, and a side view of an inkjet recording chip 61, respectively. The inkjet recording chip 61 has a through hole (ink supply port) 62 for supplying ink from the back surface thereof.

A plurality of rows of heat generating elements (not shown) that apply discharging energy to ink are arranged on both sides of the through hole 62 in the surface of the inkjet printhead substrate 11.

In addition, a discharge-port plate 12 is provided on the inkjet printhead substrate 11. The discharge-port plate 12 has a plurality of discharge ports 13 facing the heat generating elements.

A plurality of electrode pads 14 electrically connected to the heat generating elements are arranged at both ends of the surface of the inkjet printhead substrate 11.

Referring to FIG. 9, the electrode pads 14 provided on the inkjet printhead substrate 11 and a plurality of electrode leads 72 provided on a flexible film wiring substrate 71 are electrically connected by, for example, tape automated bonding (TAB). Thus, an inkjet recording element unit 73 is formed.

The inkjet recording element unit 73 includes contact pads 74 used for connection to a recording apparatus. In FIG. 9, regions enclosed by dashed lines and denoted by reference numeral 15 are to be coated and protected by a sealing resin after the electrode pads 14 and the electrode leads 72 are connected.

Then, as shown in FIG. 10, the recording element unit 73 is attached to an ink tank 81. To protect the electrically connected portions of the electrode pads 14 and the electrode leads 72 in the recording element unit 73 from corrosion due to ink or wire breaking due to externally applied force, the entirety of the connected portions are coated and protected by a sealing resin 82. Thus, an inkjet print head 83 is completed. The contact pads 74 are used to connect the inkjet print head 83 to the inkjet recording apparatus.

In such an inkjet print head, a problem due to ink leakage from the discharge ports sometimes occurs. Japanese Patent Laid-Open No. 7-60954 discloses a technique in which an ink-leakage detection sensor is provided on a flexible substrate.

However, the recording head is heated when driven and cooled when not driven. The heat causes the components constituting the inkjet print head to alternately undergo slight expansion and contraction.

In the electrically connected portions, because the linear expansion coefficients of the inkjet printhead substrate and the sealing resin are different, separation occasionally occurs at the interface between the inkjet printhead substrate and the sealing resin.

Furthermore, when such an inkjet print head is used for a long time in, for example, a high-temperature and high-humidity environment, the sealing resin is gradually degraded, sometimes resulting in separation occurring at the interface between the inkjet printhead substrate and the sealing resin.

As a result, ink sometimes penetrates into the electrically connected portions of the electrode pads provided on the inkjet printhead substrate and the electrode leads provided on the flexible film wiring substrate, resulting in malfunction such as print failure. Thus, there is a problem in that ink and sheets are wasted during continuous printing.

SUMMARY OF THE INVENTION

The present invention provides an inkjet printhead substrate that solves at least one of the above-described problems. For example, the detection sensitivity to ink penetration into the peripheral region of the electrode pads is increased to prevent malfunction such as print failure.

An inkjet printhead substrate in accordance with an aspect of the present invention includes: a heat generating element configured to generate energy for ejecting ink; an electric wire electrically connecting the heat generating element and an electrode lead provided on a flexible film wiring substrate; a protecting film configured to protect the electric wire; an electrode pad to which the electrode lead is connected, the electrode pad being formed by providing an opening in the protecting film at a position above the electric wire; a region to which a sealing resin configured to protect an electrically connected portion of the electrode pad and the electrode lead is to be applied; and an ink-detecting electrode composed of a metal wire and formed at the region to which the sealing resin is to be applied. The metal wire has a smaller width than an opening provided in the protecting film from which the metal wire is exposed.

The ink-detecting electrode is provided at the region to which the sealing resin is to be applied. The ink-detecting electrode is composed of the metal wire exposed from the protecting film. The metal wire has a smaller width than the opening provided in the protecting film from which the metal wire is exposed. This configuration solves the above-described problem.

According to the present invention, the detection sensitivity to ink penetration into the peripheral region of the electrode pads can be increased.

Further features of the present invention will become apparent from the following description of exemplary embodiments with reference to the attached drawings.

DESCRIPTION OF THE EMBODIMENTS

Herein, the term "recording" refers not only to formation of information having a meaning, such as letters and diagrams, but also broadly to formation of images, designs, and patterns (regardless of whether or not they have a meaning or are exposed so as to be visible) on recording media, and to processing of media.

Herein, the term "recording media" refers not only to paper, which is used in a typical recording apparatus, but also broadly to materials capable of receiving ink, for example, fabric, plastic films, metal plates, glass, ceramics, wood, and leather.

In addition, the term "ink" (sometimes referred to as "liquid") should be construed in a broad sense, similarly to the definition of "recording", and thus refers to liquid that is applied to recording media to form images, designs, and patterns, to process recording media, or to treat ink (for example, solidification or insolubilization of the coloring material in the ink applied to the recording media).

Figure 8A:
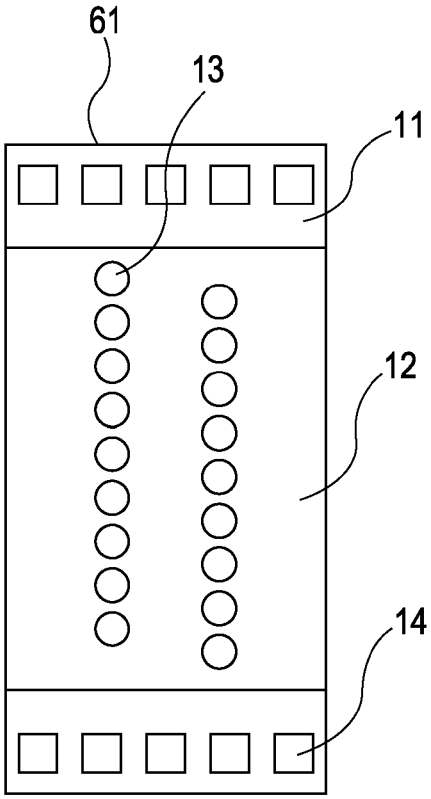
FIGS. 8A to 8C are a plan view, a bottom view, and a side view of an inkjet recording chip, respectively.
Figure 8B:
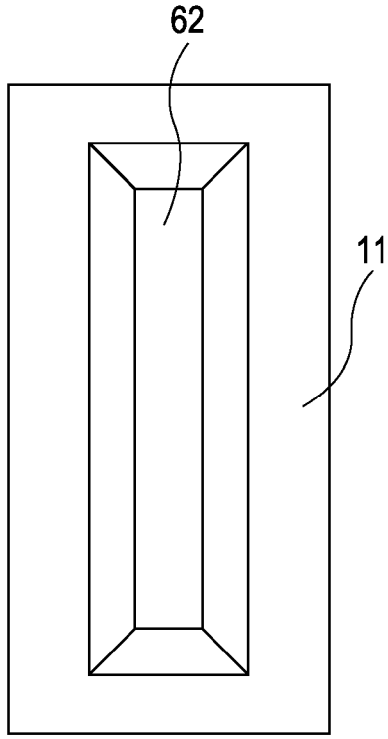
Figure 8C:
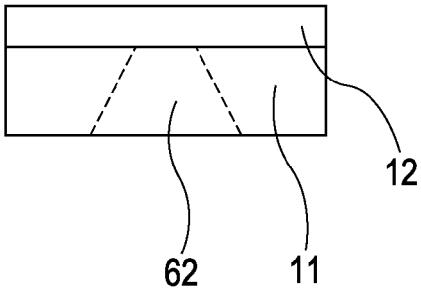

Embodiments of the present invention will be described below with reference to the drawings. Components having the same configuration as those described above with reference to FIGS. 8A to 8C, under the heading of "BACKGROUND OF THE INVENTION", are denoted by like reference numerals.

Figure 1:
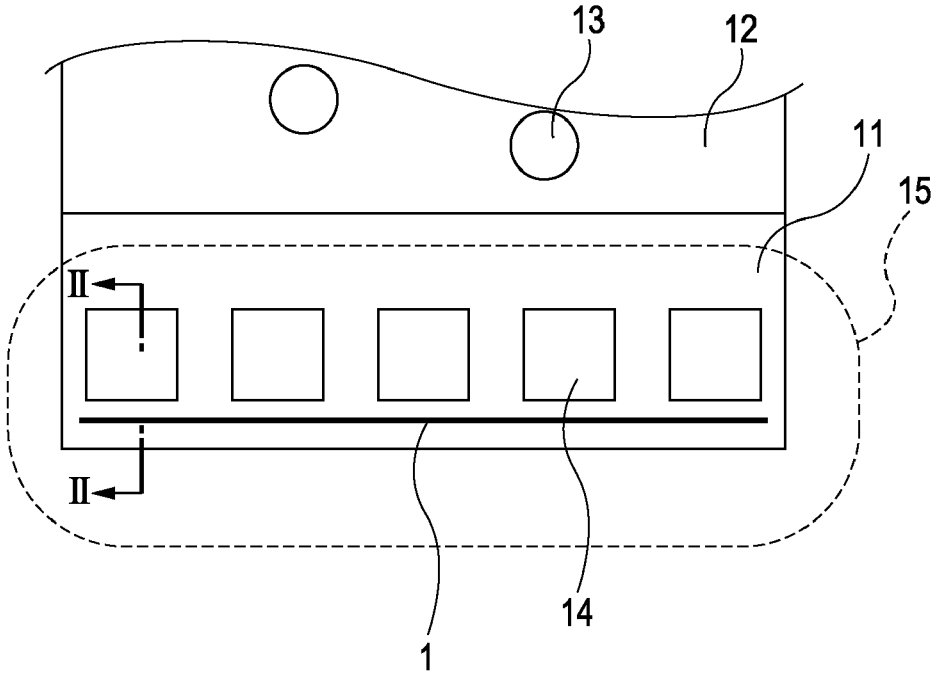
FIG. 1 is an enlarged view of a peripheral region of electrode pads on an inkjet printhead substrate of the present invention.

FIG. 1 is an enlarged view of a peripheral region of electrode pads on an inkjet printhead substrate according to an embodiment of the present invention.

In FIG. 1, energy generating elements that generate energy used to discharge liquid and a discharge-port plate 12 are provided on an inkjet printhead substrate 11. In this embodiment, the energy generating elements are heat generating elements composed of electrothermal transducers (heaters). The discharge-port plate 12 has a plurality of discharge ports 13 opposed to the heat generating elements (not shown).

Electrode pads 14 electrically connected to the heat generating elements are provided at ends of the surface of the inkjet printhead substrate 11. A metal wire serving as an ink-detecting electrode 1 is provided near the electrode pads 14.

The ink-detecting electrode 1 is a metal wire having an upper layer not covered by a protecting film. In FIG. 1, a region enclosed by a dashed line and denoted by reference numeral 15 is to be coated and protected by a sealing resin after the electrode pads 14 and electrode leads are connected.

Figure 2:
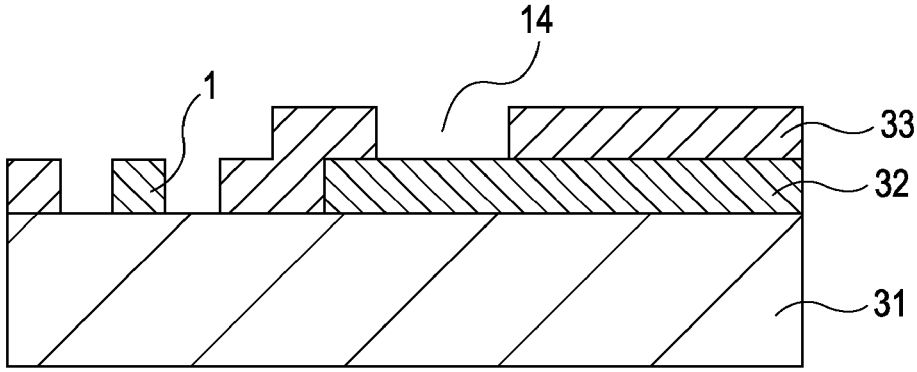
FIG. 2 is a sectional view taken along line II-II in FIG. 1.

FIG. 2 is a sectional view taken along line II-II in FIG. 1. As shown in FIG. 2, an electric wire 32, through which the heat generating elements (not shown) are electrically connected to an external wire, is formed on a silicon (Si) substrate 31 serving as a base material of the inkjet printhead substrate 11. The metal wire serving as the ink-detecting electrode 1 and the electric wire 32 are formed on the same layer, through the same photolithography process.

Then, a protecting film 33 is formed on the Si substrate 31 so as to cover the electric wire 32 and the ink-detecting electrode 1. Finally, openings are formed in the protecting film 33 at positions above the electric wire 32 to form the electrode pads 14 and an opening is formed in the protecting film 33 at a position above the metal wire serving as the ink-detecting electrode 1 to expose the metal wire. Thus, the inkjet printhead substrate 11 is completed.

Thus, the metal wire serving as the ink-detecting electrode 1 and the electric wire 32 are formed in the same process.

It is desirable that the metal wire serving as the ink-detecting electrode 1 and the electric wire 32 be made of the same material. Examples of the material include aluminum, silicon-added aluminum, copper-added aluminum, and other materials containing aluminum. These materials are suitable for the ink-detecting electrode, as will be described below, because these materials are relatively easily corroded by ink.

It is desirable that the metal wire serving as the ink-detecting electrode 1 be narrow and thin so that the ink can quickly corrode and break the metal wire. The width of the wire can be appropriately selected from, for example, 1 μm to 10 μm, and the thickness of the wire can be appropriately selected from, for example, 50 nm to 500 nm, taking into consideration the wire resistance of the electric wires for the heat generating elements, according to the required specifications and process conditions.

The metal wire serving as the ink-detecting electrode 1 and the opening in the protecting film 33 will be described in more detail below.

Figure 3:
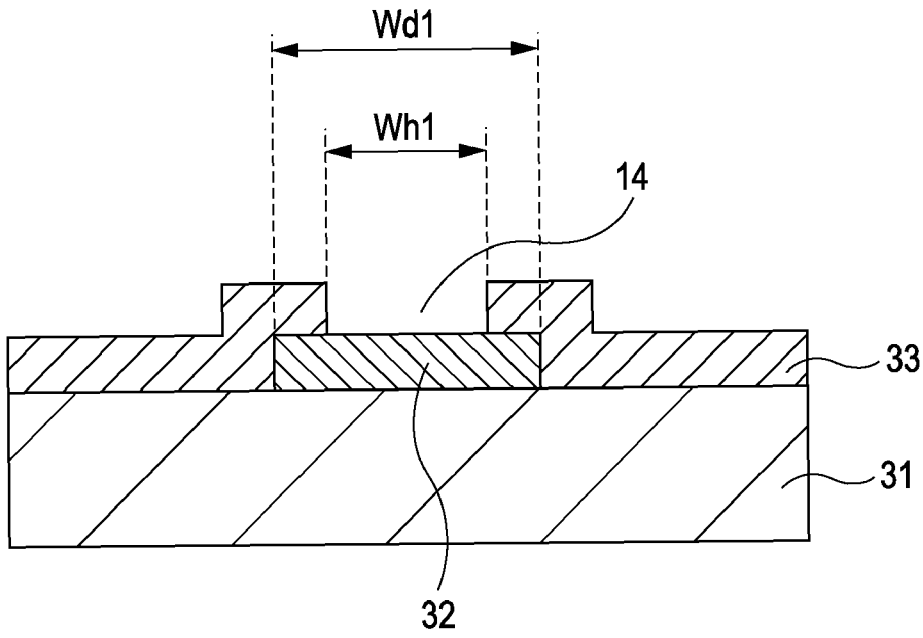
FIG. 3 is a sectional view of one of the electrode pads of the present invention.

In general, as shown in FIG. 3, the width of the openings in the protecting film 33 corresponding to the electrode pads 14 (Wh1) is smaller than the width of the electric wire 32 (Wd1), i.e., Wd1>Wh1. This structure securely protects the electrode pads 14 from liquid, such as ink, with the protecting film 33.

Figure 4:
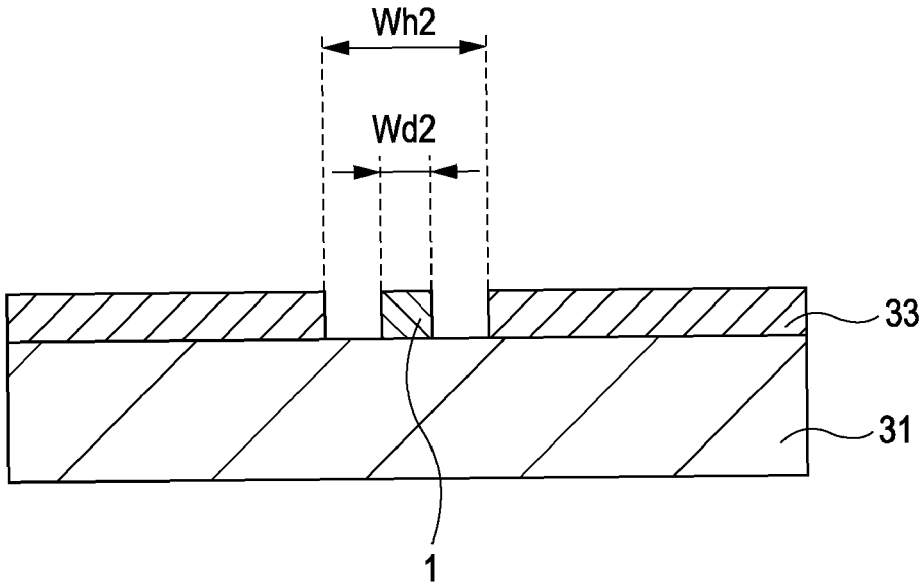
FIG. 4 is a sectional view of a portion where an ink-detecting electrode of the present invention is provided.

On the other hand, as shown in FIG. 4, the width of the opening in the protecting film 33 from which the ink-detecting electrode 1 is exposed (Wh2), is larger than the width of the metal wire serving as the ink-detecting electrode 1 (Wd2), i.e., Wd2<Wh2.

Therefore, the metal wire for detecting ink is completely exposed from the protecting film 33.

This structure enables the metal wire to easily corrode and break when touched by ink, and increases the detection sensitivity to ink penetration.

Gaps are formed between the ink-detecting electrode 1 and the protecting film 33. When ink leaks, the gaps retain the ink by the capillary force to enable the detection electrode to easily corrode and break. Thus, the detection accuracy increases.

Accordingly, the size of the opening for the metal wire serving as the ink-detecting electrode 1 and the size of the openings for typical electrode pads are determined on the basis of fundamentally different ideas.

Figure 5:
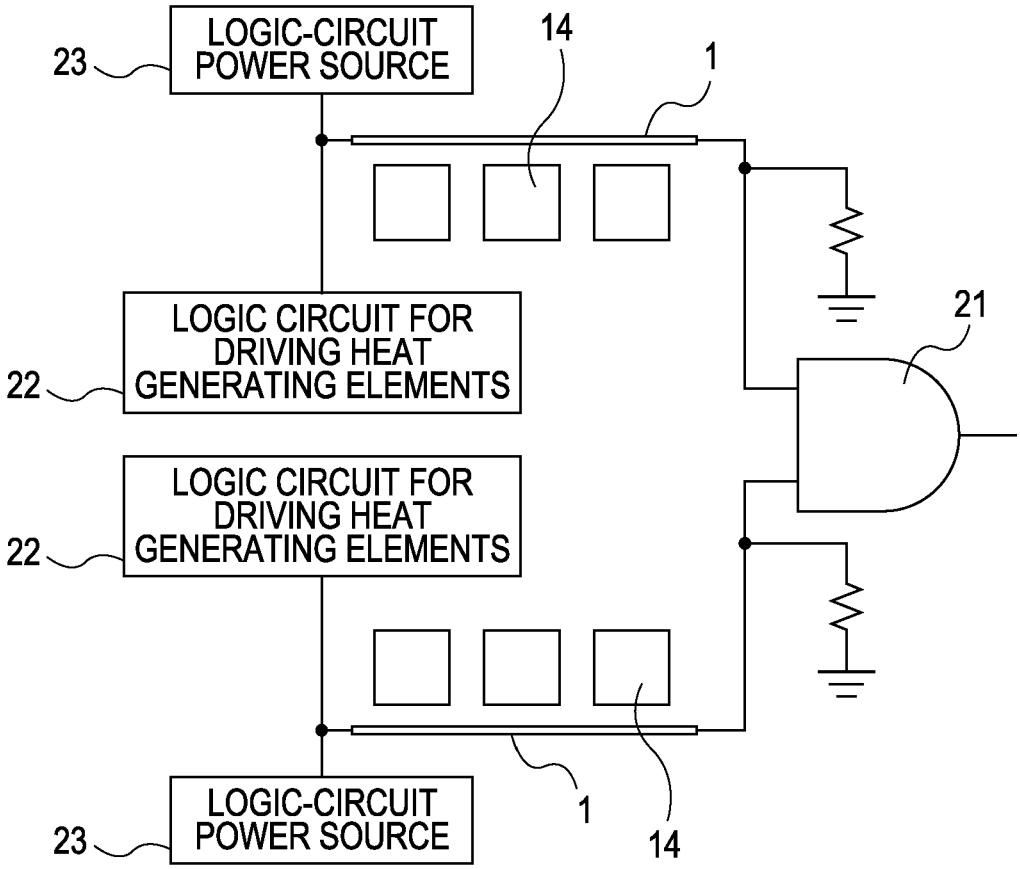
FIG. 5 shows an example of a connection circuit of metal wires, serving as the ink-detecting electrodes, of the present invention.

FIG. 5 shows an example of a connection circuit of the metal wire. The ink-detecting electrodes 1 composed of the metal wires are arranged near the electrode pads 14. The metal wires are each connected to a logic circuit 21 at one end, and branched at the other end and connected to a logic circuit 22 for driving the heat generating elements that generate discharging energy and to a logic-circuit power source 23.

This configuration enables the power to be supplied to the ink-detecting electrodes 1 with no additional electrode pads for supplying power, and therefore, the size of the inkjet printhead substrate does not need to be increased.

In this embodiment, the logic circuit 21 is an AND circuit which performs an AND operation and receives inputs from two metal wires. The number of metal wires is not limited to two, but may be three or four.

In a normal state, high-level signals are input to the logic circuit 21 because of electric potential supply from of the power sources. As a result, high-level signals are output. In contrast, when ink penetrates into the ink-detecting electrodes 1, the ink corrodes and breaks the ink-detecting electrodes 1 because the upper layers of the ink-detecting electrodes 1 are not covered by the protecting film 33.

This stops the electric potential supply from the power sources to the logic circuit 21, and pull-down resistors lower the electric potential to GND potential. Thus, low-level signals are input, and as a result, low-level signals are output.

This configuration enables detection of ink penetration into the peripheral region of the electrode pads.

There are various methods for transmitting a signal having detected ink penetration to the inkjet recording apparatus. The simplest method is to provide a dedicated output electrode pad.

Figure 9:
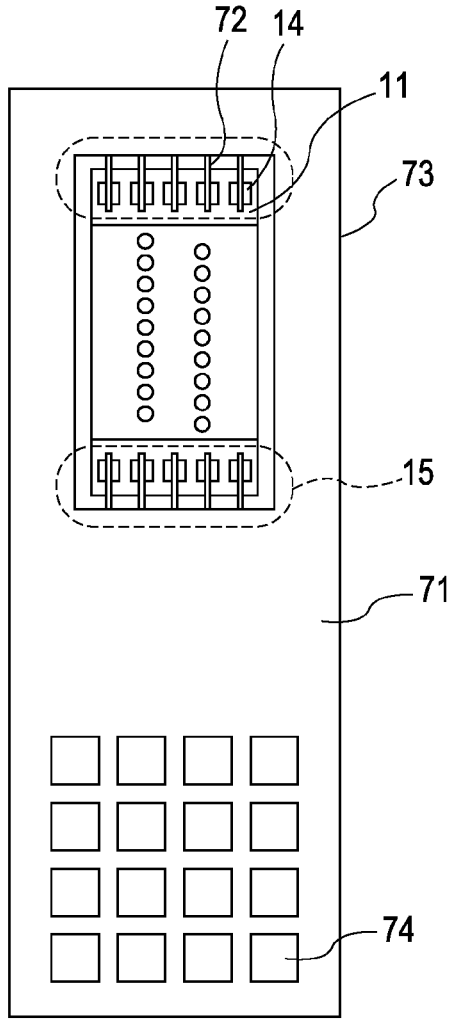
FIG. 9 is a plan view of an inkjet recording element unit.

As shown in FIG. 9, the electrode pads 14 provided on the inkjet printhead substrate 11 according to this embodiment and the electrode leads 72 provided on the flexible film wiring substrate 71 are electrically connected by, for example, TAB. Thus, the inkjet recording element unit 73 is formed.

The inkjet recording element unit 73 includes the contact pads 74 used for connection to the recording apparatus. In FIG. 9, the regions enclosed by the dashed lines and denoted by the reference numeral 15 are to be coated and protected by the sealing resin after the electrode pads 14 and the electrode leads 72 are connected.

Figure 10:
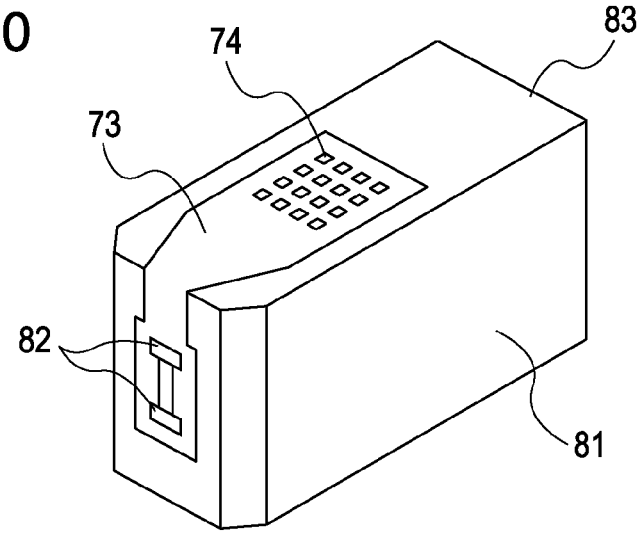
FIG. 10 is a perspective view of an inkjet print head.

Then, as shown in FIG. 10, the recording element unit 73 is attached to the ink tank 81. To protect the electrically connected portions of the electrode pads 14 and the electrode leads 72 in the recording element unit 73 from corrosion due to ink or wire breaking due to externally applied force, the entirety of the connected portions are coated and protected by the sealing resin 82. Thus, the inkjet print head 83 is completed. The contact pads 74 are used to connect the inkjet print head 83 to the inkjet recording apparatus.

Figure 11:
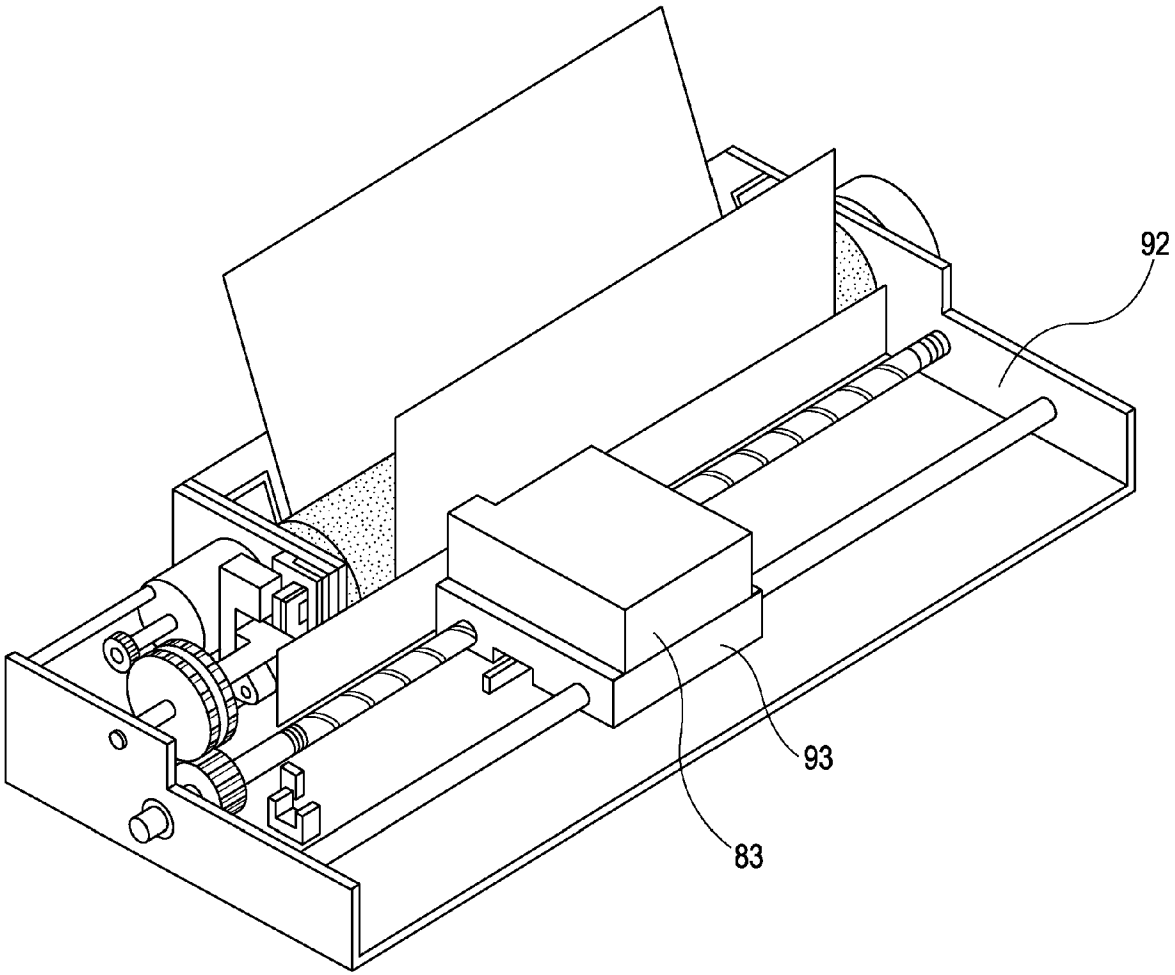
FIG. 11 is a perspective view of an inkjet recording apparatus.

The inkjet recording apparatus using the inkjet print head 83 according to this embodiment is configured as shown in FIG. 11. A paper feed mechanism for conveying a recording medium, such as paper, is provided in a main frame 92 in the main body of the recording apparatus. The main frame 92 is also provided with a carriage 93 that carries the inkjet print head 83 and reciprocates in a direction intersecting (more desirably, perpendicular to) the sheet-conveying direction.

Herein, the inkjet print head 83 mounted on the carriage 93 is of a type in which the recording head and the ink cartridge are integrated.

However, if the inkjet print head and the ink cartridge are separated, the ink cartridge is replaceable. Thus, the inkjet print head may be either fixed to the carriage or removably attached to the carriage.

Figure 12:
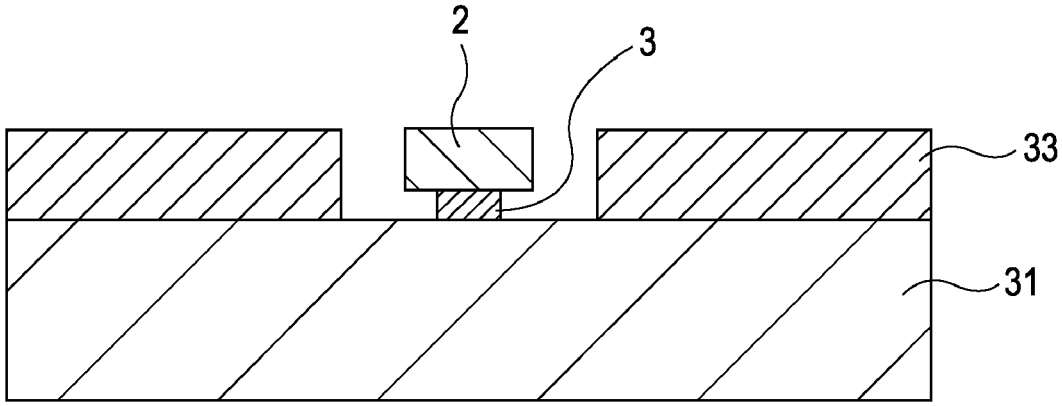
FIG. 12 shows an ink-detecting electrode according to another embodiment of the present invention.

An ink-detecting electrode according to another embodiment will be described with reference to FIG. 12. In FIG. 12, the ink-detecting electrode has a two-layer cross-section, in which a lower layer 3 has a smaller width than an upper layer 2. This structure is desirable in that the ink can corrode the upper layer 2 of the detection electrode from the top surface, the side surfaces, and the bottom surface, and thus, the detection sensitivity can be increased.

The upper layer 2 of the detection electrode may be made of the same material as the electric wire 32 according to the above-described embodiment. Examples of the material include aluminum, silicon-added aluminum, copper-added aluminum, and other materials containing aluminum. These materials are suitable for the ink-detecting electrode because these materials are relatively easily corroded by ink.

The upper layer 2 of the detection electrode may have a multilayer structure composed of, for example, a material containing aluminum and a material for improving adhesion, i.e., titanium or chromium. The lower layer 3 of the detection electrode may be made of the same material as the heat generating elements, and, for example, tantalum silicon nitride (TaSiN) or tantalum nitride (TaN) may be used.

By making the upper layer 2 of the detection electrode from the same material as the electric wire and the lower layer 3 from the same material as the heat generating elements, the sheet resistance of the upper layer 2 can be made lower than that of the lower layer 3. As a result, the upper layer 2 having a lower sheet resistance is more easily corroded by ink, which is desirable in that resistance variation during corrosion increases, and consequently, the detection sensitivity increases.

Referring to FIGS. 13A to 13D, a fabrication process of the detection electrode having a two-layer cross-section will be described. For simplicity, only the detection electrode and its peripheral portion will be explained.

Figure 13A:
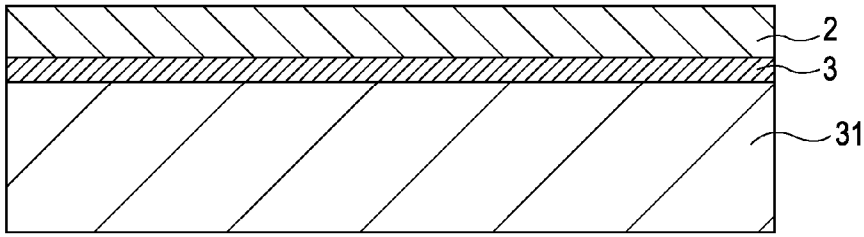
FIGS. 13A to 13D show a fabrication process of the ink-detecting electrode, of the present invention.

First, as shown in FIG. 13A, TaSiN, which constitutes the lower layer 3 of the detection electrode, and a copper-added aluminum, which constitutes the upper layer 2, are sequentially deposited on the Si substrate 31 by sputtering.

Figure 13B:
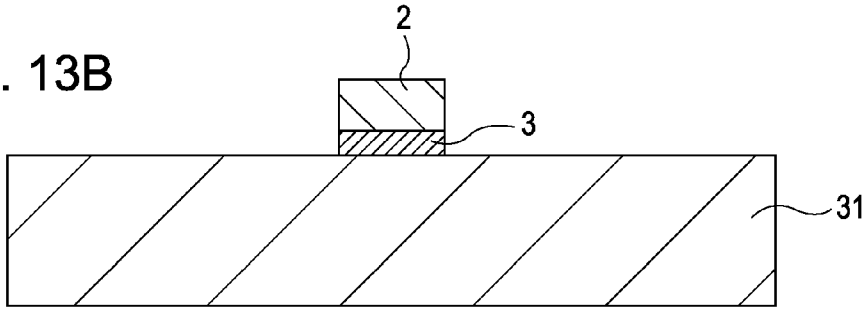

Second, as shown in FIG. 13B, the upper layer 2 and the lower layer 3 of the detection electrode are patterned into a predetermined pattern by photolithography.

Figure 13C:
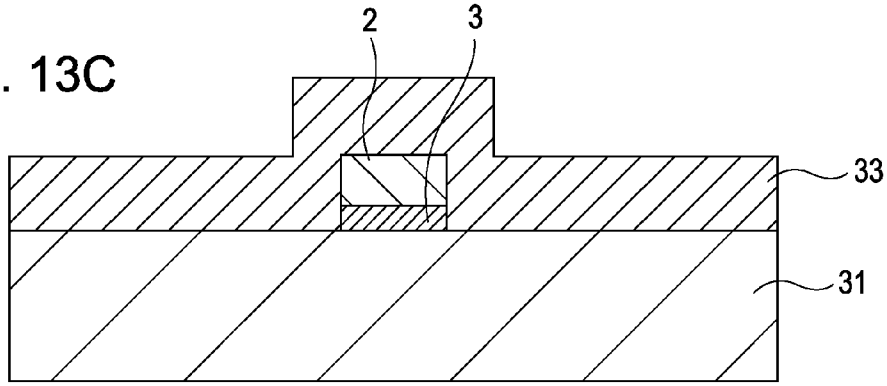

Third, as shown in FIG. 13C, SiN, which constitutes the protecting film 33, is deposited by chemical vapor deposition (CVD) so as to cover the patterned detection electrode.

Figure 13D:
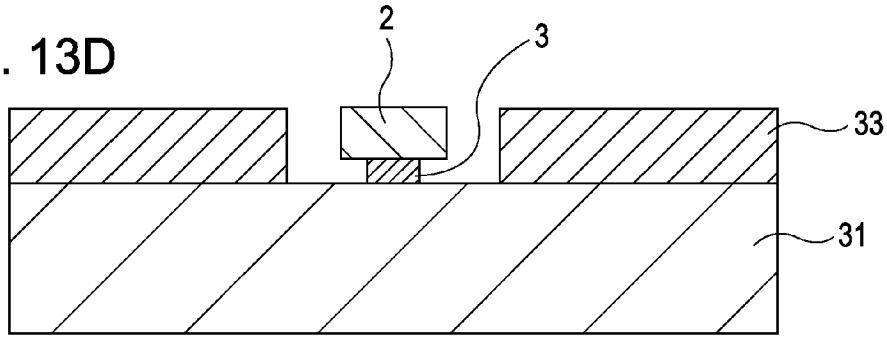

Finally, as shown in FIG. 13D, resist (not shown) is patterned by photolithography at a position where the detection electrode is to be exposed. Then, the protecting film 33 is dry-etched to from an opening. The lower layer 3 of the detection electrode is etched simultaneously with the protecting film 33 being over-etched.

Because TaSiN is used as the lower layer of the detection electrode and SiN is used as the protecting film, the lower layer and the protecting film contain the same composition. This allows the material of the lower layer of the detection electrode to be etched at a higher rate than the material of the upper layer during etching of the protecting film. Accordingly, the lower layer having a smaller width than the upper layer can be formed.

A method for transmitting a signal having detected ink penetration into the peripheral region of the electrode pads to the inkjet recording apparatus, according to another embodiment, will be described.

When the inkjet recording apparatus is provided with a connection-status output circuit for confirming a connection status of the electrically connected portions during mounting of the inkjet print head, by using the connection-status output circuit, no additional output electrode pads are required. Thus, the size of the inkjet printhead substrate does not need to be increased.

In this configuration, the output signal from the logic circuit is connected to and input to the input side of the connection-status output circuit. Thus, the output signal from the connection-status output circuit can be changed by the signal having detected ink penetration, whereby the signal can be transmitted to the inkjet recording apparatus.

Arrangement of the ink-detecting electrode according to another embodiment will be described with reference to FIG. 6.

Figure 6:
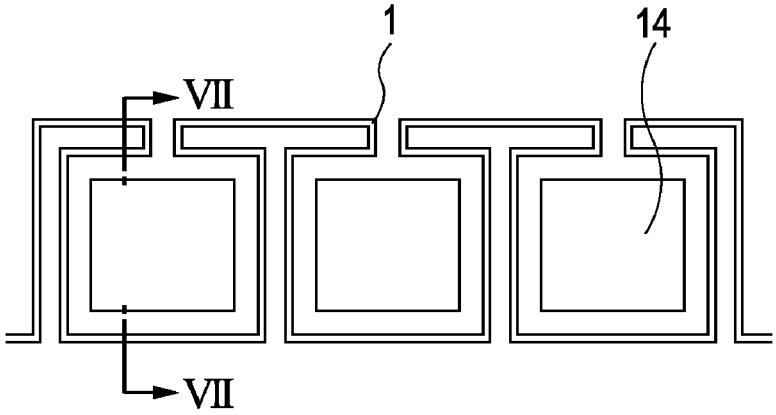
FIG. 6 shows an ink-detecting electrode according to another embodiment of the present invention.

In this embodiment, as shown in FIG. 6, the metal wire serving as the ink-detecting electrode 1 is arranged so as to surround the periphery (for example, four sides) of each of the electrode pads 14. This configuration enables to detect ink penetrated into the electrode pads 14 from any direction.

Figure 7:
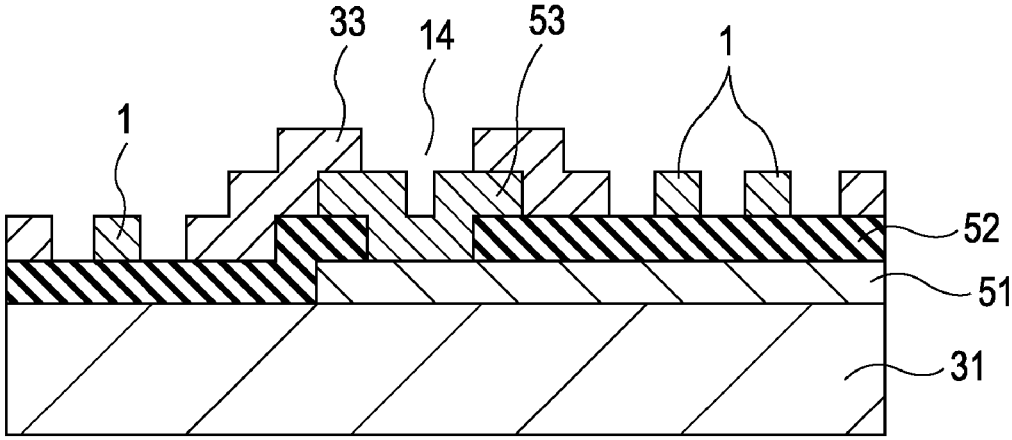
FIG. 7 is a sectional view taken along line VII-VII in FIG. 6.

FIG. 7 is a sectional view taken along line VII-VII in FIG. 6.

Electric wires for electrically connecting the heat generating elements to the external wire are formed into a multilayer interconnection structure with a first electric wire 51 and a second electric wire 53.

The first electric wire 51 is formed on the Si substrate 31, which serves as the base material of the inkjet printhead substrate 11, and an interlayer insulation film 52 is formed on the first electric wire 51. Then, the second electric wire 53 and the metal wire serving as the ink-detecting electrode 1 are simultaneously formed thereon by photolithography process.

The first electric wire 51 and the second electric wire 53 are electrically connected to each other through an opening in the interlayer insulation film 52.

The protecting film 33 is deposited on the Si substrate 31 so as to cover the second electric wire 53 and the ink-detecting electrode 1. Then, openings are formed in the protecting film 33 at positions above the second electric wire 53 to form the electrode pads 14 and an opening is formed in the protecting film 33 at a position above the metal wire serving as the ink-detecting electrode 1 to expose the metal wire. Thus, the inkjet printhead substrate 11 is completed.

In the above-described embodiments of the present invention, when ink penetrates into the electrode-pad sealing portions, the ink corrodes and breaks the ink-detecting electrode 1 composed of the metal wire that is not covered by the protecting film. Thus, ink penetration can be detected. By informing the inkjet recording apparatus of the ink penetration, supply of a print signal and power supply to the heat generating elements can be immediately stopped.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-156635 filed Jun. 16, 2008 and No. 2009-030896 filed Feb. 13, 2009, which are hereby incorporated by reference herein in their entirety.

What is claimed is:

1. An inkjet printhead substrate comprising:

a heat generating element configured to generate energy for ejecting ink;

a conductive line electrically connecting the heat generating element;

a protecting film configured to protect the conductive line;

an electrode terminal to which an electrode lead is connected, the electrode terminal being formed by providing an opening in the protecting film at a position above the conductive line; and an ink-detecting line composed of a metal material that is corroded by ink, wherein the electrode terminal and the ink-detecting line are provided in a region to which a sealing resin is to be applied, and wherein an end surface of the electrode terminal is covered by the protecting film, and an end surface of the ink-detecting electrode is not covered by the protecting film.

2. The inkjet printhead substrate according to claim 1, wherein the ink-detecting line includes an upper layer and a lower layer, the lower layer having a smaller width than the upper layer.

3. The inkjet printhead substrate according to claim 2, wherein the upper layer includes a plurality of layers.

4. The inkjet printhead substrate according to claim 2, wherein the upper layer has a lower sheet resistance than the lower layer.

5. The inkjet printhead substrate according to claim 2, wherein the lower layer contains at least one element of the protecting film.

6. The inkjet printhead substrate according to claim 1, wherein the ink-detecting line is connected to a logic circuit at one end and to a power-supply terminal at the other end.

7. The inkjet printhead substrate according to claim 6, wherein the connection of the ink-detecting line to the power-supply terminal is branched and connected to a logic circuit configured to drive the heat generating element and to a logic-circuit power source.

8. The inkjet printhead substrate according to claim 1, wherein the ink-detecting line is arranged so as to surround the electrode terminal.

9. An inkjet print head comprising:

the inkjet printhead substrate according to claim 1; and a contact terminal configured to provide electrical connection to an external device.

10. An inkjet print head comprising:

the inkjet printhead substrate according to claim 9; and a carriage configured to carry the inkjet print head and move.

11. The inkjet printhead substrate according to claim 1, wherein the ink-detecting line is composed of the same material as the electrode terminal.

12. A method for manufacturing an inkjet printhead substrate, the inkjet printhead substrate including: a heat generating element configured to generate energy for ejecting ink; a conductive line electrically connecting the heat generating element; a protecting film configured to protect the conductive line; an electrode terminal to which the electrode lead is connected, an electrode terminal being formed by providing an opening in the protecting film at a position above the conductive line; and an ink-detecting line composed of a metal material that is corroded by ink, wherein the electrode terminal and the ink-detecting line are provided in a region to which a sealing resin is to be applied, and wherein an end surface of the electrode terminal is covered by the protecting film and an end surface of the ink-detecting electrode is not covered by the protecting film, the method comprising:

forming the ink-detecting line including an upper layer and a lower layer; and etching the ink-detecting line such that the lower layer has a smaller width than the upper layer.

13. The method according to claim 12, wherein the lower layer is etched at a higher rate than the upper layer.

* * * * *